US009127508B2

(12) United States Patent
Taylor et al.

(10) Patent No.: US 9,127,508 B2
(45) Date of Patent: Sep. 8, 2015

(54) APPARATUS AND METHODS UTILIZING PROGRESSIVE CAVITY MOTORS AND PUMPS WITH INDEPENDENT STAGES

(75) Inventors: Kyle L. Taylor, Spring, TX (US); Sundaie L. Klotzer, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 739 days.

(21) Appl. No.: 13/347,471

(22) Filed: Jan. 10, 2012

(65) Prior Publication Data

US 2013/0175093 A1 Jul. 11, 2013

(51) Int. Cl.
*E21B 4/02* (2006.01)
*F04B 47/08* (2006.01)

(52) U.S. Cl.
CPC .. *E21B 4/02* (2013.01); *F04B 47/08* (2013.01)

(58) Field of Classification Search
CPC ..... E21B 4/02; E21B 4/003; E21B 41/0085
USPC ..... 175/107, 61; 418/48
See application file for complete search history.

(56) References Cited

U.S. PATENT DOCUMENTS

| | | | | |
|---|---|---|---|---|
| 3,912,426 | A * | 10/1975 | Tschirky | 418/48 |
| 3,999,901 | A * | 12/1976 | Tschirky | 418/48 |
| 4,227,584 | A | 10/1980 | Driver | |
| 4,585,401 | A * | 4/1986 | Baldenko et al. | 418/5 |
| 5,050,692 | A | 9/1991 | Beimgraben | |
| 5,126,610 | A | 6/1992 | Fremerey | |
| 5,209,294 | A | 5/1993 | Weber | |
| 5,474,334 | A | 12/1995 | Eppink | |
| 5,725,053 | A | 3/1998 | Weber | |
| 6,050,346 | A | 4/2000 | Hipp | |
| 6,173,794 | B1 | 1/2001 | von Gynz-Rekowski et al. | |
| 7,204,326 | B2 | 4/2007 | Downie et al. | |
| 7,481,281 | B2 | 1/2009 | Schuaf | |
| 7,650,952 | B2 | 1/2010 | Evans et al. | |
| 2002/0066568 | A1 | 6/2002 | Buchanan et al. | |
| 2002/0088648 | A1 * | 7/2002 | Krueger et al. | 175/99 |
| 2007/0251729 | A1 | 11/2007 | Sand et al. | |
| 2008/0128171 | A1 | 6/2008 | Weston et al. | |
| 2010/0038142 | A1 | 2/2010 | Snyder et al. | |
| 2010/0314172 | A1 | 12/2010 | Underwood et al. | |
| 2010/0322808 | A1 * | 12/2010 | Guidry, Jr. | 418/48 |

FOREIGN PATENT DOCUMENTS

| | | |
|---|---|---|
| EP | 0736128 B1 | 8/1998 |
| WO | WO8912178 | 12/1989 |

(Continued)

OTHER PUBLICATIONS

International Search Report and Written Opinion dated Apr. 25, 2013 for International Application No. PCT/US2013/020747; all references in PCT are cited above.

(Continued)

*Primary Examiner* — Catherine Loikith
(74) *Attorney, Agent, or Firm* — Cantor Colburn LLP

(57) ABSTRACT

A drilling apparatus includes a progressive cavity device that includes a plurality of linearly coupled rotors. Each rotor is disposed in a separate stator. Adjoining stators are separated by a coupling device configured to provide lateral support to the rotors. The stators may be enclosed in a common housing. The adjoining stator sections may be rigidly connected to each other.

15 Claims, 3 Drawing Sheets

(56) References Cited

FOREIGN PATENT DOCUMENTS

| | | |
|---|---|---|
| WO | WO9519488 | 7/1995 |
| WO | WO2011074972 A1 | 6/2011 |

OTHER PUBLICATIONS

PCT International Preliminary Report on Patentability; International Application No. PCT/US2013/020747; International Filing Date: Jan. 9, 2013; Date of Mailing: Jul. 24, 2014; pp. 1-9.

* cited by examiner

APPARATUS AND METHODS UTILIZING PROGRESSIVE CAVITY MOTORS AND PUMPS WITH INDEPENDENT STAGES

BACKGROUND

1. Field of the Disclosure

This disclosure relates generally to apparatus for use in wellbore operations that utilize progressive cavity power devices.

2. Background of the Art

To obtain hydrocarbons, such as oil and gas, boreholes or wellbores are drilled by rotating a drill bit attached to a drill string end. A large number of the current drilling activity involves drilling deviated and horizontal boreholes for hydrocarbon production. Current drilling systems utilized for drilling such wellbores generally employ a motor (commonly referred to as a "mud motor" or "drilling motor") to rotate the drill bit. A typical mud motor includes a power section that includes a rotor having an outer lobed surface disposed inside a stator having a compatible inner lobed surface. The power section forms progressive cavities between the rotor and stator lobed surfaces. Also, certain pumps used in the oil industry utilize progressive cavity power sections. The rotor is typically made from a metal, such as steel, and includes helically contoured lobes on its outer surface. The stator typically includes a metal housing lined inside with an elastomeric material that forms helical contours or lobes on the inner surface of the stator. For high temperature applications, metal rotor and metal stator motors have been proposed. Pressurized fluid (commonly known as the "mud" or "drilling fluid") is pumped into the progressive cavities formed between the rotor and stator lobes. The force of the pressurized fluid pumped into the cavities causes the rotor to turn in a planetary-type motion.

The disclosure herein provides progressive cavity devices, such a mud motors and pumps, that include serially coupled independent power sections or stages.

SUMMARY OF THE DISCLOSURE

In one aspect, a drilling apparatus is disclosed that in one embodiment includes a progressive cavity device having a plurality of linearly coupled independent power sections, each such power section including a rotor disposed in a separate stator, wherein a coupling device between the independent power sections provides lateral or radial support to the adjoining rotors. In another aspect, the coupling device may also connect the adjoining stators. In another aspect, the coupled power sections may be placed in a common housing. In another aspect, the adjoining stators may be rigidly connected to each other.

In another aspect, a method of drilling a wellbore is disclosed that in one embodiment may include: deploying a drill string in the wellbore that includes a drilling motor coupled to a drill bit at an end of the drill string, wherein the drilling motor includes a plurality of linearly coupled power sections, wherein a coupling device between the power sections provides a lateral or radial support to the rotors; and supplying fluid under pressure to the drilling motor to drill the wellbore.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

The disclosure herein is best understood with reference to the accompanying figures in which like numerals have generally been assigned to like elements and in which.

DESCRIPTION OF THE EMBODIMENTS

Figure 1:
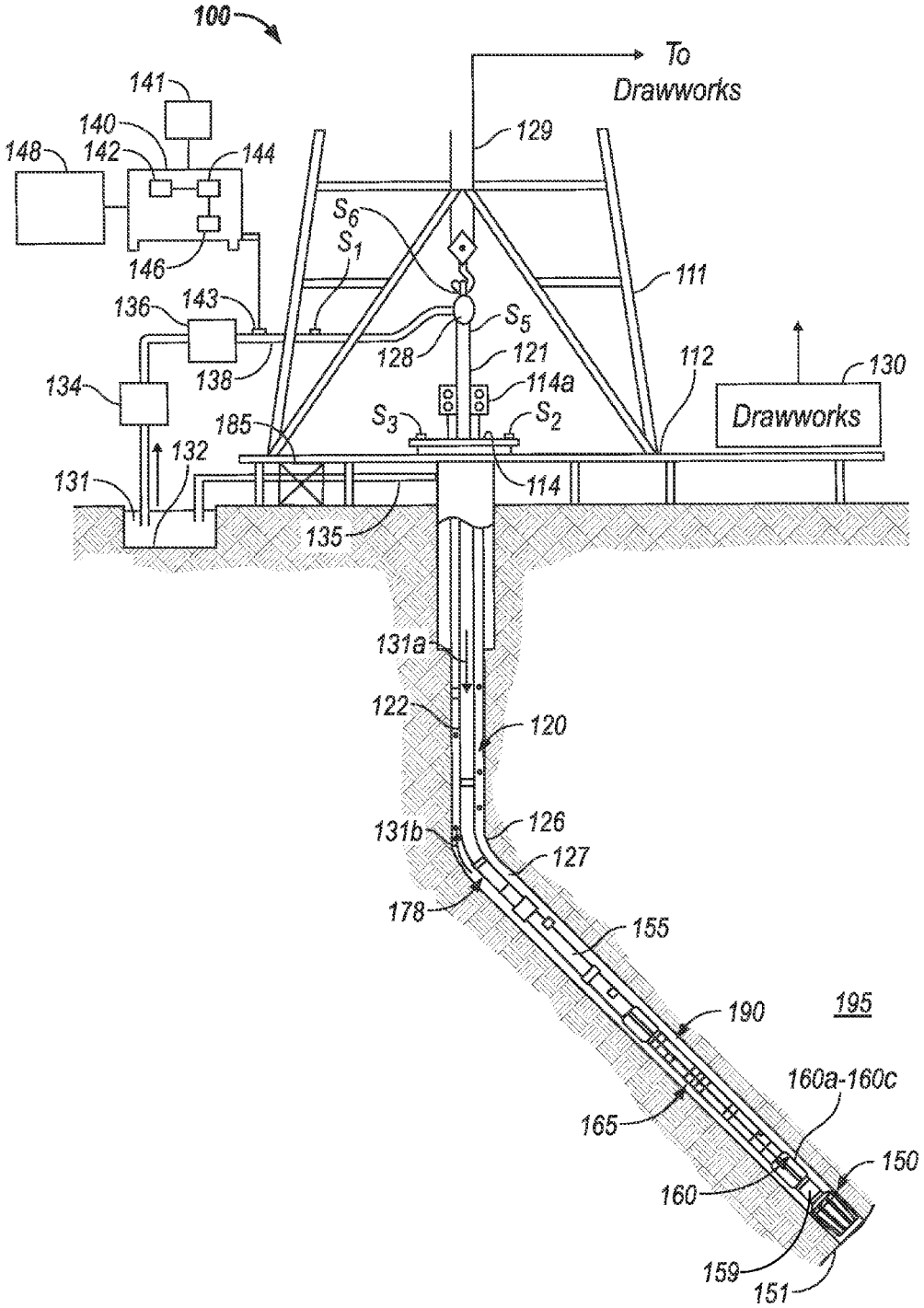
FIG. 1 is an elevation view of a drilling system that includes a device for determining direction of the drill string during drilling of the wellbore.

FIG. 1 is a schematic diagram of an exemplary drilling system 100 that includes a drill string 120 having a drilling assembly or a bottomhole assembly 190 attached to its bottom end. Drill string 120 is conveyed in a borehole 126. The drilling system 100 includes a conventional derrick 111 erected on a platform or floor 112 that supports a rotary table 114 that is rotated by a prime mover, such as an electric motor (not shown), at a desired rotational speed. A tubing (such as jointed drill pipe) 122, having the drilling assembly 190 attached at its bottom end, extends from the surface to the bottom 151 of the borehole 126. A drill bit 150, attached to drilling assembly 190, disintegrates the geological formations when it is rotated to drill the borehole 126. The drill string 120 is coupled to a draw works 130 via a Kelly joint 121, swivel 128 and line 129 through a pulley. Draw works 130 is operated to control the weight on bit ("WOB"). The drill string 120 may be rotated by a top drive 114*a* rather than the prime mover and the rotary table 114.

In one aspect, a suitable drilling fluid 131 (also referred to as the "mud") from a source 132 thereof, such as a mud pit, is circulated under pressure through the drill string 120 by a mud pump 134. The drilling fluid 131 passes from the mud pump 134 into the drill string 120 via a desurger 136 and the fluid line 138. The drilling fluid 131*a* from the drilling tubular 122 discharges at the borehole bottom 151 through openings in the drill bit 150. The returning drilling fluid 131*b* circulates uphole through the annular space or annulus 127 between the drill string 120 and the borehole 126 and returns to the mud pit 132 via a return line 135 and a screen 185 that removes the drill cuttings from the returning drilling fluid 131*b*. A sensor $S_1$ in line 138 provides information about the fluid flow rate of the fluid 131. Surface torque sensor $S_2$ and a sensor $S_3$ associated with the drill string 120 provide information about the torque and the rotational speed of the drill string 120. Rate of penetration of the drill string 120 may be determined from sensor $S_5$, while the sensor $S_6$ may provide the hook load of the drill string 120.

In some applications, the drill bit 150 is rotated by rotating the drill pipe 122. However, in other applications, a downhole motor 155 (mud motor) disposed in the drilling assembly 190 rotates the drill bit 150 alone or in addition to the drill string rotation.

A surface control unit or controller 140 receives signals from the downhole sensors and devices via a sensor 143 placed in the fluid line 138 and signals from sensors $S_1$-$S_6$ and other sensors used in the system 100 and processes such signals according to programmed instructions provided by a program to the surface control unit 140. The surface control unit 140 displays desired drilling parameters and other information on a display/monitor 141 that is utilized by an operator to control the drilling operations. The surface control unit 140 may be a computer-based unit that may include a processor 142 (such as a microprocessor), a storage device 144, such as a solid-state memory, tape or hard disc, and one or more computer programs 146 in the storage device 144 that are accessible to the processor 142 for executing instructions contained in such programs. The surface control unit 140 may further communicate with a remote control unit 148. The surface control unit 140 may process data relating to the drilling operations, data from the sensors and devices on the surface, data received from downhole devices and may control one or more operations of the The drilling assembly 190 may also contain formation evaluation sensors or devices (also referred to as measurement-while-drilling, "MWD," or logging-while-drilling, "LWD," sensors) various properties of interest, such as resistivity, density, porosity, permeability, acoustic properties, nuclear-magnetic resonance properties, corrosive properties of the fluids or the formation, salt or saline content, and other selected properties of the formation 195 surrounding the drilling assembly 190. Such sensors are generally known in the art and for convenience are collectively denoted herein by numeral 165. The drilling assembly 190 may further include a variety of other sensors and communication devices 159 for controlling and/or determining one or more functions and properties of the drilling assembly 190 (such as velocity, vibration, bending moment, acceleration, oscillations, whirl, stick-slip, etc.) and drilling operating parameters, such as weight-on-bit, fluid flow rate, pressure, temperature, rate of penetration, azimuth, tool face, drill bit rotation, etc.

Still referring to FIG. 1, the drill string 120 further includes a power generation device 178 configured to provide electrical power or energy, such as current, to sensors 165, devices 159 and other devices. Power generation device 178 may be located in the drilling assembly 190 or drill string 120. The drilling assembly 190 further includes a steering device 160 that includes steering members (also referred to a force application members) 160*a*, 160*b*, 160*c* that may be configured to independently apply force on the borehole 126 to steer the drill bit along any particular direction. In aspects, the drilling motor 150 includes two or more serially coupled independent power sections, as described in more detail in reference to FIGS. 2-7.

Figure 2:
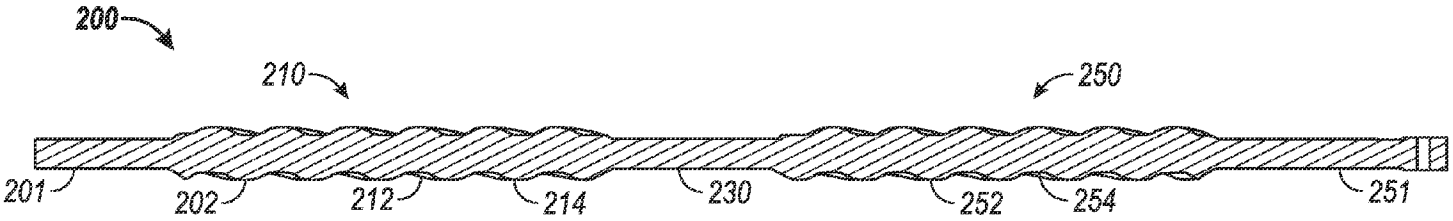
FIG. 2 shows an embodiment of a two stage rotor made from a continuous metallic member that may be utilized in a mud motor made according to an embodiment of the disclosure.

FIG. 2 shows an embodiment of a two-stage rotor 200 made from a continuous metallic member 201 that may be utilized in a mud motor made according to an embodiment of the disclosure. The rotor 200 shown includes two stages (also referred to herein as "sections") 210 and 250. Stage 210 includes a number of lobes 212 at its outer surface 214 and a front end shaft member 202. Stage or section 250 includes a number of lobes 252 on an outer surface 254 and terminates with a shaft member 251. The stages 210 and 250 are connected by a middle member 230.

Figure 3:
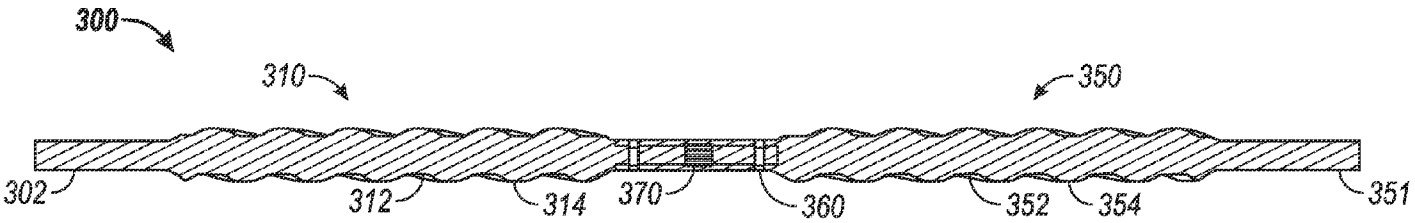
FIG. 3 shows an embodiment of a two-stage rotor wherein the two rotor stages are serially joined by a coupling member that may be utilized in a mud motor made according to an embodiment of the disclosure.
Figure 4:
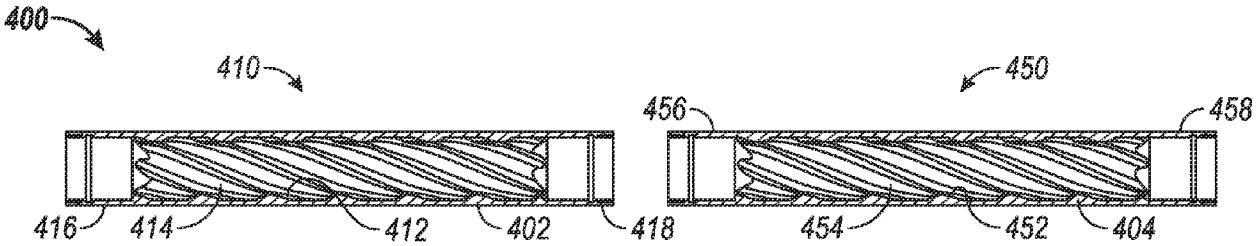
FIG. 4 is an embodiment of a two stage stator compliant with the rotors shown in FIGS. 2 and 3.

FIG. 3 shows an alternative embodiment of a two-stage or two-section rotor 300 wherein the two rotor stages are serially joined by a coupling member. The rotor 300 includes stages or sections 310 and 350. Stage 310 includes a number of lobes 312 at an outer surface 314 and a front end shaft member 302. Stage or section 350 includes a number of lobes 352 on an outer surface 354 and terminates with a shaft member 351. The stages 310 and 350 are coupled at joint 360 by a key connection 370, wherein FIG. 4 is an embodiment of two-stage stator 400. The stator 400 includes independent stators or stator stages 410 and 450, wherein stator stage 410 is compliant with the rotor stages 210 (FIG. 2) and rotor stage 310 (FIG. 3) while stator stage 450 is compliant with rotor stage 250 (FIG. 2) and rotor stage 350 (FIG. 3) so that rotors 210 or 310 may be inserted in the stator stage 410 to form a first power section of a mud motor, while rotors 250 or 350 may be inserted in the stator section 450 to form a second power section of the mud motor. Stator stage 410 includes lobes 412 on an inner surface 414 of a tubular member 402. Similarly, the stator stage 450 includes lobes 452 on an inner surface 454 of a tubular 404. The lobes 210 and 310 are compliant with the lobes 412 of the stator stage 410 and rotor lobes 252 and 352 are compliant with the lobes 452 of the stator stage 450. Stator stage 410 terminates with a front connection end 416 and a tail connection end 418. Stator stage 450 terminates with a front connection end 456 and a tail connection end 458. The number of lobes on a rotor is one less than the number of lobes on its corresponding stator. Although two rotor stages and two stator stages are shown, a mud motor made according to this disclosure may include more than two stages or sections. Also, the number of lobes and the number of cavities may be the same for each stage or may differ from each other.

Figure 5:
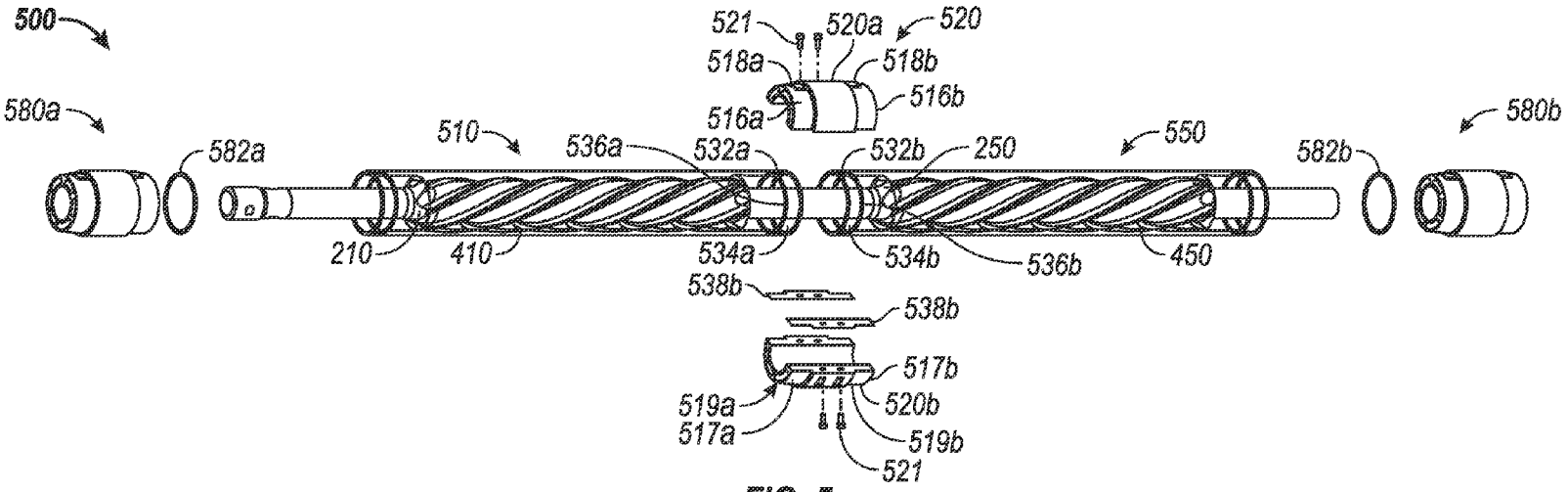
FIG. 5 shows an isometric view of a rotor shown in FIG. 2 or FIG. 3 disposed in the stator stages shown in FIG. 4 and coupling members for serially joining the stator stages and the rotor stages.

FIG. 5 shows an isometric view of certain components that may be assembled to form a power section of a two-stage mud motor 500. The mud motor 500 includes a first power section or stage 510 that includes a first rotor section, such as rotor section 210 shown in FIG. 2, disposed inside a corresponding first stator section, such as section 410 shown in FIG. 4, and a second power section or stage 550 that includes a second rotor section, such as rotor section 250 shown in FIG. 2 disposed inside a corresponding second stator section, such as stator section 450 shown in FIG. 4. A first solid bearing stabilizer 580*a* and O-ring 582*a* are connected at a distal end of the first power section or stage 510. A second solid bearing stabilizer 580*b* and O-ring 582*b* are connected at a distal end of the second power section or stage 550. In aspects, the first and second power sections 510 and 550 form independent power stages of the mud motor 500, each stage including a separate rotor and a stator. The mud motor 500 is shown with two power stages for ease of explanation. A mud motor or pump made according to an embodiment of this disclosure, however, may include any number of power stages and, further, different stages may include rotors and stators with different number of lobes and such stages may be of different overall lengths. Further, these power stages may be serially connected by any suitable mechanism.

Still referring to FIG. 5, power stages 510 and 550 are shown connected by a stabilizing bearing 520, which is mechanically keyed into the adjoining power stages 510 and 550 to form the power section of the 500. The particular stabilizing bearing 520 is a split design that includes two halves 520*a* and 520*b* that may be fastened to the stator sections with screws 521. An end 516*a* of the stabilizing bearing half 520*a* includes a key slot 518*a* that keys into key slots 532*a* in the stator 510, while the an end 516*b* of the stabilizer bearing half 520*a* includes a key 518*b* that keys into key slots 532*b* in the stator 450. Similarly, end 517*a* of the stabilizing bearing half 520*b* includes a key slot 519*a* that keys into key slots 534*a* in the stator 410, while the end 517*b* of the stabilizer bearing half 520*b* includes a key 519*b* that keys into a key slot 534*b* in the stator 450. O-rings 536*a* and 536*b* may be provided in the stators 410 and 450 respectively to form seals between the ends 520*a* and 520*b* of the bearing 520 and the stators 410 and 450. Gaskets 538*a* and 538*b* may be inserted between the stabilizing bearing halves 520*a* and 520*b* to provide seals between the two halves. In aspects, installing the stabilizing bearing 510 over the section 230 between the rotors 210 and 250 allows the rotors to act as a single body. The bearing 520 also provides an axial or serial connection between stators 410 and 450 and lateral or radial stabilization to the rotors 210 and 250.

Figure 6:
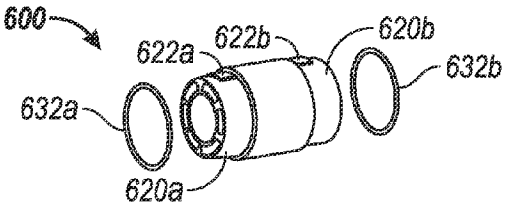
FIG. 6 shows an isometric view of a power section assembled using the components shown in FIG. 5 disposed in a continuous housing.

In another configuration, the stabilizing bearing may be made as a solid member. In one configuration, such a bearing may include no split members or screws but at least one key and an o-ring at each end. An exemplary solid bearing 600 is shown in FIG. 6. Bearing 600 includes ends 620*a* and 620*b* that respectively connect to stators 410 and 420 shown in FIG. 5 via keys 622*a* and 622*b*. O-rings 632*a* and 632*b* respectively provide seals between the bearing 600 and the stators 410 and 420. With the solid bearing design, the rotor stages, such as stages 210 and 250 (FIG. 5) may be made as separate members, i.e., without a common connecting rod, such as shown in FIG. 3. In such a case, independent rotor sections are installed through the solid stabilizing bearing. Such rotor sections may then be mechanically keyed to one another for anti-rotation and to prevent axial disengagement from each other. The stator sections may be designed in independent single stages, such as shown in FIG. 4 and keyed to the stabilizing bearing 600 to axially separate the stator stages. The ends of the independent stator stages are extended to allow for an o-ring groove and anti-rotational key, such as shown in FIG. 5. At each end of a stator stage, a clearance between the stabilizing bearing and the beginning of the stator stage may be provided to allow flow of the drilling fluid flow through the motor.

Figure 7:
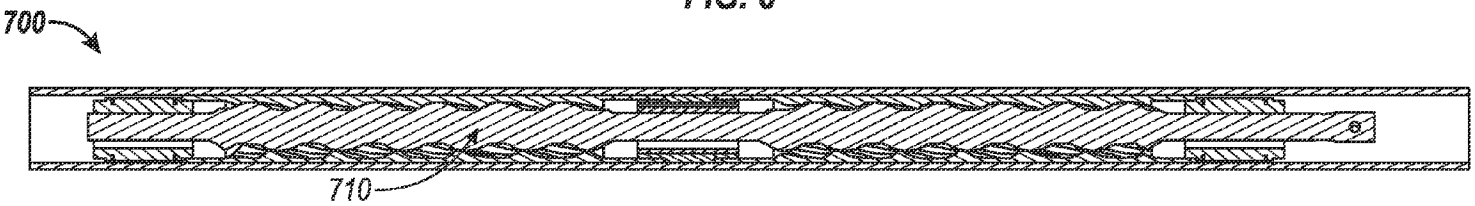
FIG. 7 shows the linearly joined power sections shown in FIG. 5 placed in a common housing to form the power section of the mud motor.

Referring to FIGS. 5 and 6, with ether the solid or split stabilizing bearing, the rotor, stator, and stabilizing bearing are assembled together prior to installation in a main power section housing, such as housing 700, shown in FIG. 7. Retaining features may be used to enclose the assembly 710 of the rotors inside the stators into compression, preventing axial movement.

In other aspects, two or more power stages may be axially coupled without a stabilizing bearing. In such a configuration, the adjoining stators alone may be keyed to one another or mechanically connected by another suitable mechanism, such as welding. Utilizing axially coupled independent stator stages permits making such stages short in length, which provides the ability to hold tighter tolerances, allows for a simpler overall machining process and the use of alternative manufacturing techniques. In other aspects, a stabilizing bearing may control the eccentric movement of the rotor during operations and control the gap between the rotor and the stator thereby reducing contact wear between the rotor and stator lobes. Such a design also does not prevent the rotor lobes from making solid contact with the stator lobes. In other aspects, a stabilizing bearing positioned between each power stage of the motor power section provides support for each of the rotors, which reduces the natural frequency of the rotors, which in turn decreases wear of the lobes, thus improving overall performance of the mud motor. Because the stabilizing bearing is relatively short in length, it allows the use of various anti-wear coating processes that often cannot be used on a rotor or stator. Such coatings result in extending the life of the entire mud motor power section. The power stages may include metal-metal rotor and stator stages or the stator lobes may be elastomeric.

While the foregoing disclosure is directed to the certain exemplary embodiments of the disclosure, various modifications will be apparent to those skilled in the art. It is intended that all variations within the scope and spirit of the appended claims be embraced by the foregoing disclosure.

The invention claimed is:

1. An apparatus for use in a wellbore, comprising:

a plurality of serially coupled power sections, wherein each power section includes a rotor disposed in a stator; and a coupling device configured to couple stators of adjoining power sections, wherein the coupling device includes a first end fastened to an outside of the stator of a first of the adjoining power sections and a second end fastened to an outside of the stator of a second of the adjoining power sections to provide a lateral support to the rotors of the adjoining power sections.

2. The apparatus of claim 1, wherein the coupling device is selected from a group consisting of: (i) a solid bearing device; and (ii) a split bearing device.

3. The apparatus of claim 1, wherein the coupling device further provides a seal between the stators in the adjoining power sections.

4. The apparatus of claim 1 further comprising a housing enclosing the plurality of serially coupled power sections.

5. The apparatus of claim 1, wherein each stator is a separate member.

6. The apparatus of claim 5, wherein rotors in the adjoining power sections are made from a common metallic member with a solid member between the rotors.

7. The apparatus of claim 1, wherein the rotors in the adjoining power sections are coupled to each other by a coupling member with a key connection.

8. The apparatus of claim 1, wherein the coupling device includes a key that connects the coupling device to a key slot of the stator of one of the first and second adjoining power sections.

9. The apparatus of claim 1, wherein each rotor includes a lobe on an outer surface thereof and each stator includes a lobe on an inner surface thereof and wherein the coupling device does not prevent the lobe of each such rotor from contacting the lobe of the stator in which such rotor is disposed.

10. The apparatus of claim 1, wherein each rotor is configured to rotate when a fluid under pressure is supplied to a first power section in the plurality of power sections, and wherein the apparatus further comprises:

a drive shaft coupled to an end power section in the plurality of serially coupled power sections;

a drill bit connected to the drill shaft; and a sensor configured to provide measurements relating a parameter of interest.

11. The apparatus of claim 1, wherein the coupling device axially separates the stator of the first of the adjoining power sections and the stator of the second of the adjoining power sections.

12. A method of drilling a wellbore, comprising:

conveying a drilling assembly in the wellbore, the drilling assembly including a drilling motor having at least two serially coupled power sections, each such power section including a rotor disposed in an associated stator and a coupling device configured to couple stators of the at least two power sections, wherein the coupling device includes a first end fastened to an outside of the stator of a first of the at least two adjoining power sections and a second end fastened to an outside of the stator of a second the at least two adjoining power sections to provide a lateral support to each of the rotors; and a drill bit at an end of the drilling assembly configured to be rotated by the drilling motor; and supplying a fluid under pressure to the drilling motor to rotate each of the rotors in the at the at least two power sections to rotate the drill bit to drill the wellbore.

13. The method of claim 12 further comprising directing the drill bit along a selected direction to drill a deviated wellbore.

14. The method of claim 12 further comprising estimating a downhole parameter of interest during drilling of the wellbore.

15. The method of claim 14 further comprising steering the drill bit in response to the determined downhole parameter.

* * * * *